US007717122B2

(12) United States Patent
Jacobs et al.

(10) Patent No.: US 7,717,122 B2
(45) Date of Patent: May 18, 2010

(54) LIGHTWEIGHT SINGLE TUBE CRUTCH

(75) Inventors: David P. Jacobs, Highland Park, IL (US); Ishwor P. Adhikari, Mundelein, IL (US)

(73) Assignee: Medline Industries, Inc., Mundelein, IL (US)

( * ) Notice: Subject to any disclaimer, the term of this patent is extended or adjusted under 35 U.S.C. 154(b) by 77 days.

(21) Appl. No.: 11/804,437

(22) Filed: May 17, 2007

(65) Prior Publication Data

US 2008/0283103 A1 Nov. 20, 2008

(51) Int. Cl.
*A61H 3/02* (2006.01)

(52) U.S. Cl. ..... 135/69; 135/72

(58) Field of Classification Search ..... 135/65, 135/68, 69, 72, 71, 73, 75
See application file for complete search history.

(56) References Cited

U.S. PATENT DOCUMENTS

| | | | | | |
|---|---|---|---|---|---|
| 37,387 | A | * | 1/1863 | Davis | 135/72 |
| 1,192,290 | A | * | 7/1916 | Engstrom | 135/69 |
| 1,652,110 | A | * | 12/1927 | Fullington | 135/69 |
| 2,116,730 | A | * | 5/1938 | Menton | 135/69 |
| 2,312,786 | A | * | 3/1943 | Wilson | 135/68 |
| 2,383,786 | A | * | 8/1945 | Gish | 135/69 |
| 2,429,409 | A | * | 10/1947 | Eidman | 135/72 |
| 3,272,210 | A | * | 9/1966 | Boruvka | 135/69 |
| 3,304,946 | A | * | 2/1967 | Lutes | 135/69 |
| 3,417,765 | A | | 12/1968 | Slater et al. | 135/50 |
| 4,252,138 | A | | 2/1981 | Fowler | 135/69 |
| 4,509,741 | A | | 4/1985 | Smith | 272/69 |
| 4,846,203 | A | | 7/1989 | Tappel | 135/69 |
| 4,979,533 | A | | 12/1990 | Hansen et al. | 135/69 |
| 5,025,820 | A | * | 6/1991 | Gamper | 135/69 |
| 5,139,040 | A | * | 8/1992 | Kelly | 135/69 |
| 5,954,074 | A | | 9/1999 | Mattson | 135/68 |
| 6,085,766 | A | * | 7/2000 | Geary | 135/75 |
| 6,851,438 | B2 | | 2/2005 | Battiston | 135/72 |
| 7,104,271 | B2 | | 9/2006 | Larson et al. | 135/73 |

OTHER PUBLICATIONS

Rehabilitation Research and Development Center, DVA Health Care System brochure entitled "The design of a complaint composite crutch" Palo Alto, California 94304 (18 pages) (Date estimated at least as early as May 16, 2007).

Millennial Medical—design by asi brochure entitled "Understanding Crutch Ergonomics" (10 pages) (Date estimated, based on document copyright date, at least as early as Dec. 31, 2004).

* cited by examiner

*Primary Examiner*—David Dunn
*Assistant Examiner*—Noah Chandler Hawk
(74) *Attorney, Agent, or Firm*—Nixon Peabody LLP

(57) ABSTRACT

A height adjustable crutch includes a single tube member, a foot grip, an underarm support, and a handle. The single tube member has a central axis along which a main member, a telescoping top member, and a telescoping foot member are aligned. The top member is adjustable relative to a top end of the main member. The foot member is adjustable relative to bottom end of the main member. The foot grip is fixedly attached to the foot member, and the underarm support is fixedly attached to a top end of the top member. The underarm support is generally perpendicular to the central axis of the single tube member. The handle is fixedly attached to the main member and is offset from the central axis of the single tube such that a gap separates a central area of the handle and the main member.

6 Claims, 4 Drawing Sheets

LIGHTWEIGHT SINGLE TUBE CRUTCH

FIELD OF THE INVENTION

The present invention relates generally to crutches. More particularly, the present invention relates to a single tube crutch of light weight and having a fixed handle.

BACKGROUND OF THE INVENTION

Crutches have long been used as walking aids when experiencing short-term or long-term walking disabilities. Some factors used to select an appropriate crutch include crutch cost, crutch weight, crutch adjustability, crutch comfort, and crutch stability. Although many different types of crutches are available, the currently available crutches are plagued by one or more problems.

For example, one problem associated with some current crutches is that they are too expensive. One of the most familiar types of crutches uses two parallel bowed tubes that are connected by an adjustable handle near a central region of the crutch and by an underarm support near the upper end of the crutch. Using two tubes increases the cost of materials used in manufacturing the crutch, which, in turn, increases the final cost to the consumer.

Another problem associated with some current crutches is that they have a high weight. For example, while the parallel-tube type of crutch described above may weigh only a few ounces more than a single-tube crutch, the comfort level and ease of use when using a single-tube crutch is generally higher than when using a parallel-tube crutch. In fact, a small child or an elderly person is more likely to benefit from a crutch having a weight that is reduced by even a few ounces. When reducing the weight of the crutch, however, one must ensure that the crutch is still able to sustain and support the appropriate weight for the user (i.e., have a proper, generally high, weight capacity). Thus, simply reducing the weight of the crutch, by itself, does not provide a solution to providing a low weight crutch that is stable and has a high weight capacity.

While single-tube crutches provide certain advantages over parallel-tube crutches, the currently available single-tube crutches present additional problems. A problem associated with current single-tube crutches is that they are not ergonomically shaped, and, thus, they can cause fatigue and discomfort to the crutch user. For example, some crutch users can experience great discomfort when using a single-tube crutch having a small-sized or improperly shaped underarm support. Each time the user swings the single-tube crutch, the frictional contact resulting between the underarm support and the user's underarm can cause pain and irritation.

Some current single-tube crutches also fail to provide an adjustment mechanism that is convenient, simple, and stable. For example, having an adjustable handle inherently increases the likelihood that the crutch may become unstable and likely cause great injury to the user. Because the handle can be adjusted (i.e., moved from one position to another position), the user must always be cautious to properly secure the handle in its current position. An improperly secured handle can result in the user falling and likely suffering great injury. Even if the handle is initially properly secured, the handle can be inadvertently moved during use (e.g., continuous interaction between the user's hands and the handle can cause the handle's displacement). For example, if the adjustable handle is secured to one of its positions by a screw and a nut, the nut may loosen over time and cause the adjustable handle to fail in supporting the user.

Yet another problem with some single-tube crutches is that the handle is not positioned in a comfortable and convenient position. When using a crutch, the user places the underarm support under his or her underarm and grasps the handle for support. However, the handle in current single-tube crutches is positioned along the axis of the crutch tube and, accordingly, causes the user to awkwardly bend his or her arms inward to grasp the handle. Positioning the handle parallel to the tube, or inward of the tube towards the user's body, decreases stability and increases discomfort when using the single-tube crutch.

Therefore, there exists a need for an ergonomically designed single-tube crutch having a fixed handle for providing user stability and comfort. The present invention is directed to satisfying one or more of these needs and solving other problems.

SUMMARY OF THE INVENTION

According to one embodiment, a height adjustable crutch includes a single tube member, a foot grip, an underarm support, and a handle. The single tube member has a central axis along which a main member, a telescoping top member, and a telescoping foot member are aligned. The top member is adjustable relative to a top end of the main member. The foot member is adjustable relative to bottom end of the main member. The foot grip is fixedly attached to the foot member and the underarm support is fixedly attached to a top end of the top member. The underarm support is generally perpendicular to the central axis of the single tube member. The handle is fixedly attached to the main member and is offset from the central axis of the single tube such that a gap separates a central area of the handle and the main member.

According to another embodiment, a method of manufacturing a height adjustable crutch includes providing a single tube member having a main member, a top member, and a foot member aligned along a central axis. The top member is telescopically attached to the main member such that the top member is adjustable relative to the main member along the central axis. An underarm support is attached to a top end of the top member, the underarm support being generally perpendicular to the central axis. A handle is securely fixed to the main member in an offset position via a bracket, a central area of the handle being separated from the main member by a gap.

According to a further embodiment, a height adjustable crutch is used as a walking aid and includes a single columnar member, an underarm support, and a grip handle. The single columnar member has a central axis and includes a main member and an underarm member aligned along the central axis, the underarm member and the main member being telescopically adjustable relative to each other. The underarm support is coupled to the underarm member, the underarm support having an elongated shape and being positioned so that its longest dimension is generally perpendicular to the central axis of the columnar member. The grip handle is coupled to the main member via a handle bracket and has a generally circular cross-sectional shape. The grip handle is positioned such that a user can grip all regions of a central area of the grip handle, the regions including a region facing the main member. The grip handle is positioned generally perpendicular to and spaced away from the main member.

The above summary of the present invention is not intended to represent each embodiment or every aspect of the present invention. The detailed description and Figures will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
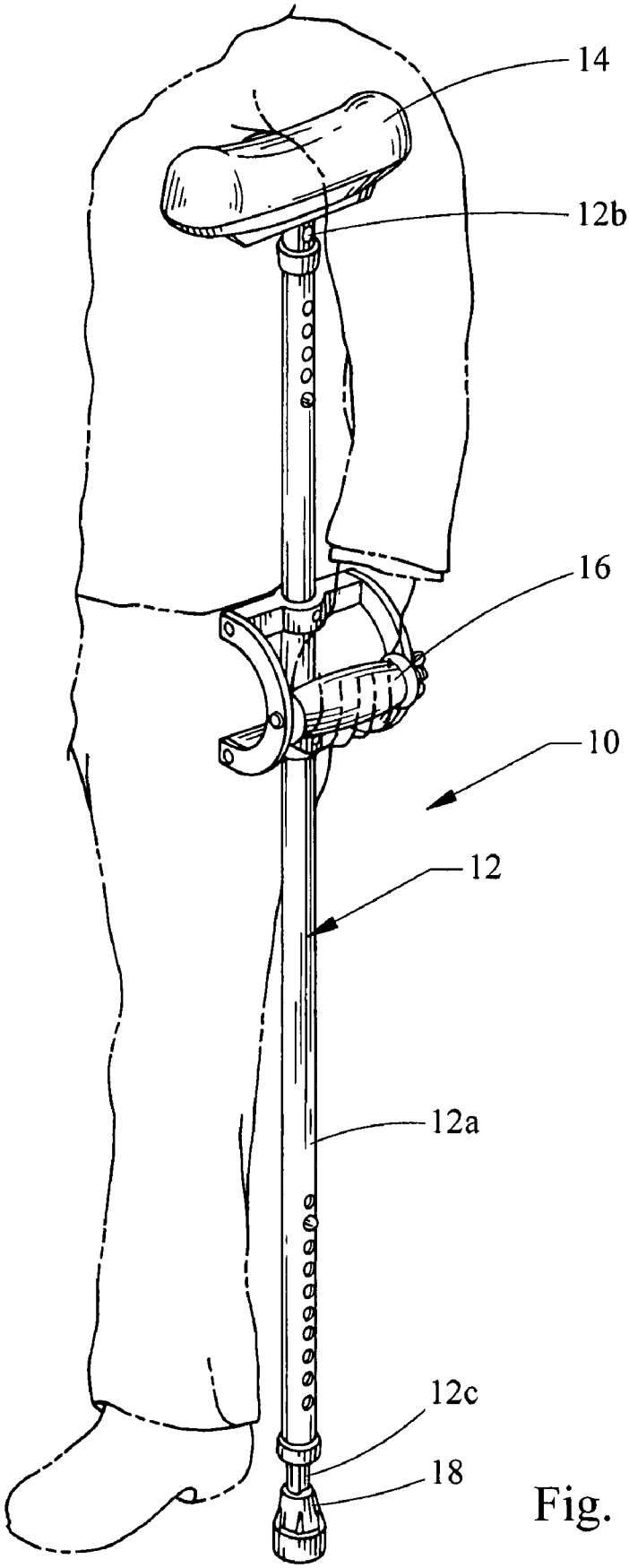
FIG. 1 illustrates a perspective view of a height adjustable crutch having an underarm support, a handle, and a foot member.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention.

DESCRIPTION OF ILLUSTRATIVE EMBODIMENTS

Referring to FIG. 1, a height adjustable crutch 10 includes a single tube member 12, an underarm support 14, a handle assembly 16, and a foot grip 18. The single tube member 12 includes a main member 12*a*, a telescoping top member 12*b*, and a telescoping foot member 12*c*, all three members being aligned along a central axis of the tube member 12. The top member 12*b* is adjustably (or telescopically) attached near or at a top end of the main member 12*a*. The foot member 12*c* is adjustably (or telescopically) attached near or at a bottom end of the main member 12*a*. As illustrated, a crutch user places the underarm support 14 under his or her underarm and grasps the handle 16 when using the crutch 10.

The crutch 10 is generally designed, in comparison to other available crutches, to have a low cost and low weight, and, further, to provide improved convenience, comfort, and stability for the user. For example, the crutch 10 can be made from a low-weight material such as aluminum and use approximately 30% less material than other available crutches. The crutch 10 provides a user with adequate support, having at least a 300 pound weight capacity. The single tube member 12 is the main weight-receiving member of the height adjustable crutch 10.

Figure 2:
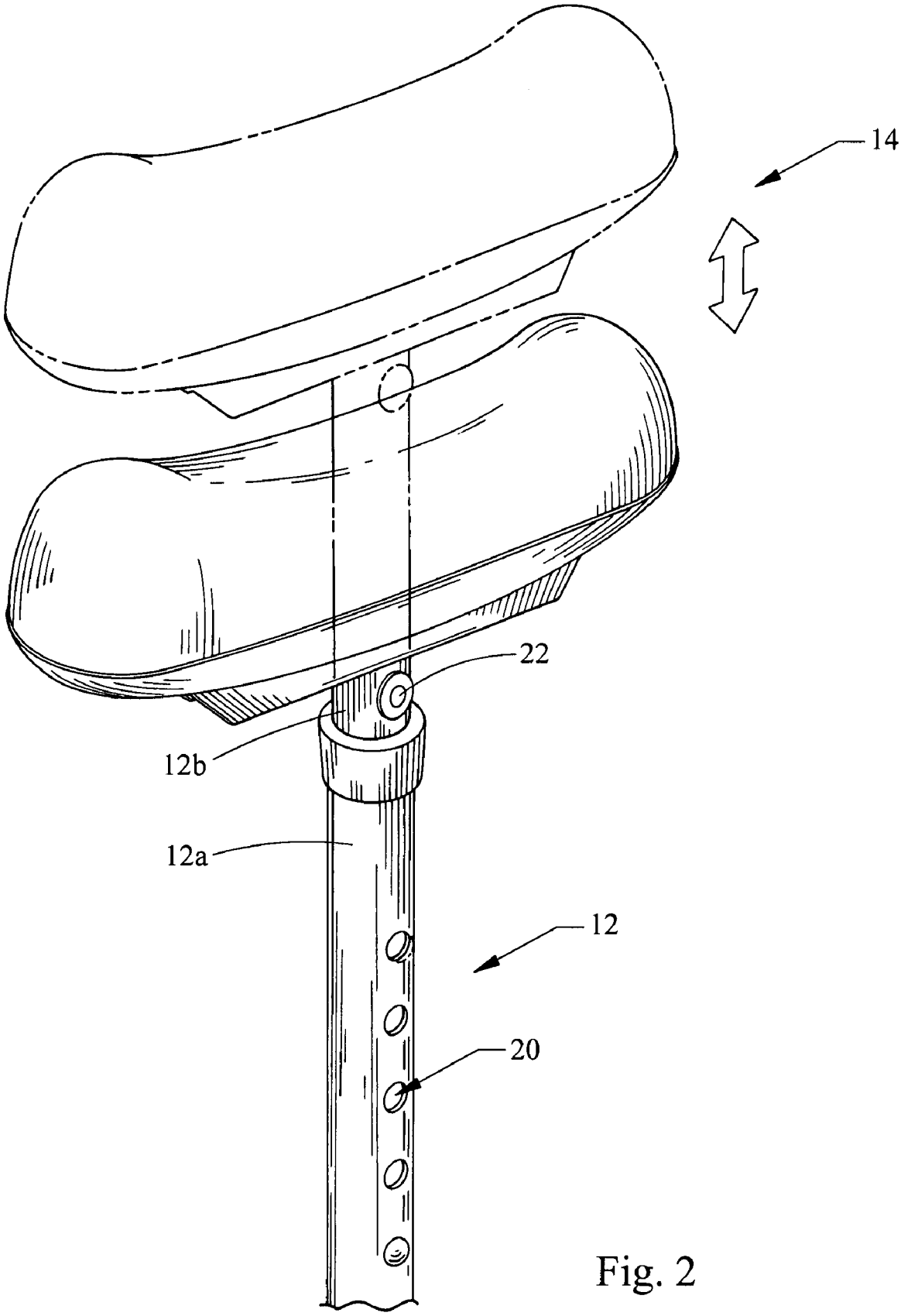
FIG. 2 illustrates an enlarged perspective view of the underarm support.

Referring to FIG. 2, the underarm support 14 is fixedly attached to a top end and generally perpendicular to the central axis of the tube member 12. Specifically, the underarm support 14 is attached to a top end of the top member 12*b*. Although the underarm support 14 is fixedly attached to the top member 12*b*, it can be adjusted relative to the main member 12*a* via a plurality of top apertures 20. The top apertures 20 are located near or at the top end of the main member 12*a* for receiving a top push-button 22 when adjusting the top member 12*b* relative to the main member 12*a*. Any other mechanism can be used in addition to or instead of a push-button, which is generally a spring-loaded pin. For example, instead of the top push-button 22 a pin or a clip can also be used. The underarm support 14 is optionally made from rubber (such as, e.g., petroleum-based rubber or foam rubber) and can include padding to make it even more comfortable for a user. Alternatively, any material which provides the user with a comfortable and stable support can be used in the underarm support 14.

When adjustment of the underarm support 14 is desired, the user depresses the top push-button 22 inwardly to release the top member 12*b* relative to the main member 12*a*. The user then slides the top member 12*b* to a desired position, which corresponds to a respective one of the top apertures 20, and allows the top push-button 22 to protrude (or click) into a respective top aperture 20 to lock the top member 12*b* relative to the main member 12*a*. Optionally, the underarm support 14 is longer than a grip handle 24 (described below) to provide increased comfort and support for the user.

Figure 3C:
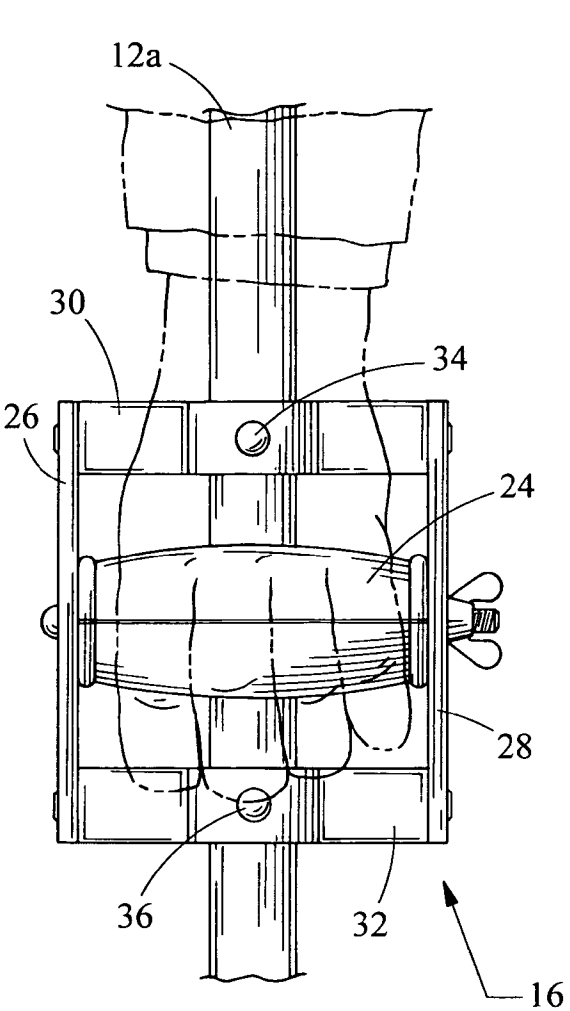
FIG. 3C illustrates a front planar view of the handle.
Figure 3B:
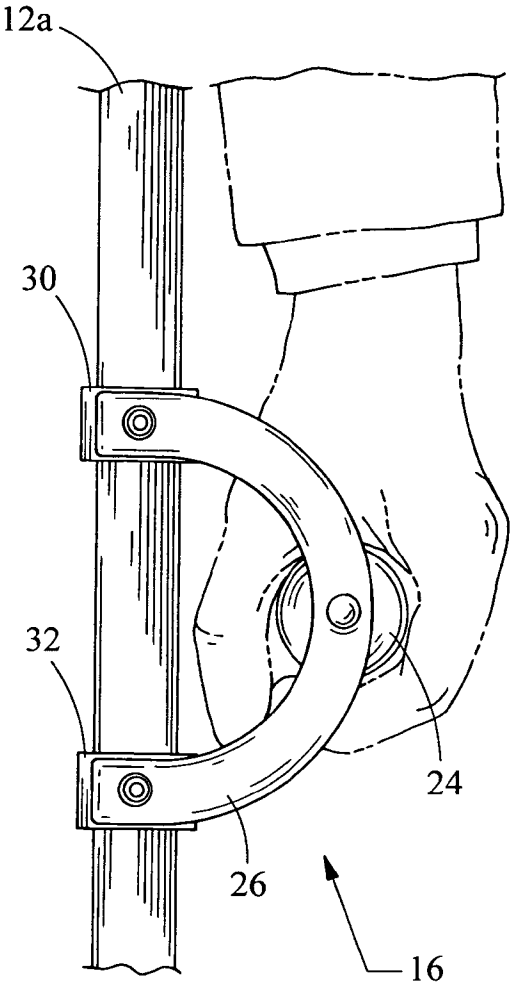
FIG. 3B illustrates a side planar view of the handle.
Figure 3A:
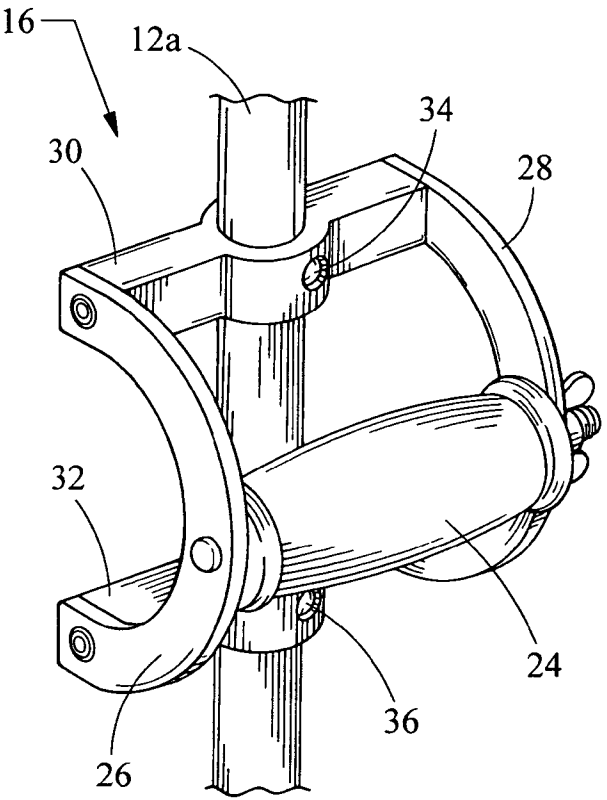
FIG. 3A illustrates an enlarged perspective view of the handle.

Referring to FIGS. 3A-3C, the handle assembly 16 includes the grip handle 24 and a bracket having a pair of vertical members 26, 28 and a pair of horizontal members 30, 32. The grip handle 24 is offset from the central axis of the single tube member 12 such that a user's hand can grasp the grip handle 24 without interference from any of the vertical members 26, 28 and the horizontal members 30, 32. Thus, a central area of the grip handle 24 is separated by a gap from the main member 12*a*. As illustrated in the exemplary embodiment, the vertical members 26, 28 are located generally parallel to each other and attached, respectively, to an end of the grip handle 24. Each of the vertical members 26, 28 is generally c-shaped and coupled at each end to a respective end of the horizontal members 30, 32.

The grip handle 24 is fixedly attached to the vertical members 26, 28 using any suitable attachment means. For example, a screw and nut combination is used to connect each end of the grip handle 24 to a respective one of the vertical members 26, 28. In other examples, the attachment means can include welding, adhesive, riveting, etc.

The horizontal members 30, 32 are coupled to the main member 12*a* of the single tube 12. Specifically, each of the horizontal members 30, 32 has a centrally located hole through which the main member 12*a* is inserted. Optionally, each of the horizontal members 30, 32 includes a respective securing aperture 34, 36 for receiving a securing pin to fixedly attach the horizontal members 30, 32 to the single tube 12. In alternative embodiments, other attachment means can be used for fixedly attaching the horizontal members 30, 32 to the single tube member 12, including welding means, adhesive means, etc. For example, the horizontal members 30, 32 can be attached to the single tube member 12 using a plurality of rivets inserted through a respective securing aperture 34, 36.

The fixed attachment of the handle assembly 16 to the single tube member 12 provides a substantially stronger support for the downward force applied by a user's frame than is provided by other available crutches. Accordingly, some advantages that are provided include maximum mobility, increased user comfort, ease of object reach, increased self-esteem, etc. For example, the handle assembly 16 is less likely to move relative to the single tube member 12 when supporting a user and, therefore, is likely to increase the user's safety and peace of mind. Similarly, the user is likely to be more confident when using the crutch 10 and, therefore, he or she can achieve maximum mobility. In other words, instead of reluctantly relying on the crutch 10 because of concern for falling down and suffering further injury, the user is confidently using the crutch 10 to perform any movements suitable for a crutch. To increase the user's self-esteem, the handle assembly 16 can have different colors than the single tube member 12, or any other member of the crutch 10, to show a more personalized look.

The grip handle 24 can be made from a rubber material and/or a plastic material and can include more than one material. For example, the grip handle 24 can include an outer covering member that is comprised of a textured rubber material that is strong and durable. Optionally, the grip is water resistant. The rubber material can be, for example, a petroleum-based rubber or a foam rubber. The grip handle 24 can also include an inner member that can optionally be a hollow cylinder. The inner member may be comprised of plastic or any other type of suitable material for receiving a fastener. In general, the inner member provides support and rigidity, and the outer rubber member provides a more comfortable feeling for the user. In one embodiment, the grip handle 24 is fitted for the size of a user's hand and is smaller than the underarm support 14.

Any one or more of the vertical 26, 28 and the horizontal members 30, 32 can be made using one or more of a plastic material, an aluminum material, a steel material, a nylon material, or a fiber material. The foot grip 18 can be made of rubber. Optionally, in alternative embodiments, other materials can be used for any components of the crutch 10, including wood, aluminum alloys, steel alloys, etc.

Figure 4:
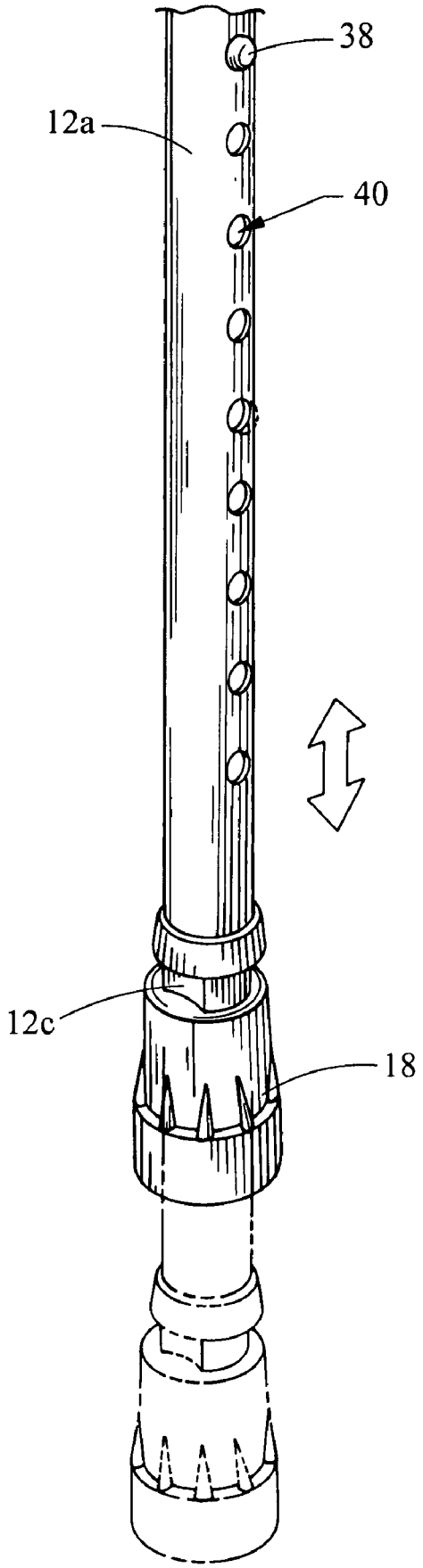
FIG. 4 illustrates an enlarged perspective view of a foot member.

Referring to FIG. 4, the foot grip 18 is fixedly attached to the telescoping foot member 12*c*, which is slidably adjustable within the main member 12*a* of the single tube member 12. The foot grip 18 provides a frictional force between the single tube member 12 and a supporting surface (e.g., floor, street, etc.). Optionally, the foot grip 18 includes or is replaced by one or more metal prongs for use on ice or slippery surfaces.

The foot member 12*c* includes a bottom push-button 38, and the main member 12*a* includes a plurality of bottom apertures 40. When adjustment of the foot grip 18 is desired, the user depresses the bottom push-button 38 inwardly to release the foot member 12*c* relative to the main member 12*a*. The user then slides the foot member 12*c* to a desired position, which corresponds to a respective one of the bottom apertures 40, and allows the bottom push-button 38 to protrude into a respective bottom aperture 40 to lock the foot member 12*c* relative to the main member 12*a*.

Optionally, the crutch 10 includes a spring member for shock reduction to provide comfort for the user. The spring member is generally coupled between the main member 12*a* and the foot member 12*c* such that it absorbs at least some force resulting from contact occurring between the foot grip 18 and a supporting surface.

The crutch 10 can be manufactured such that it can have any dimensions based on particular design preferences and in accordance with the current invention. Some exemplary dimensions are provided for the crutch 10 and some of its components. For example, the crutch 10 can have an overall height range between about 1,145 millimeters (45.08 inches) and about 1,452 millimeters (57.17 inches). The underarm support 14 (or at least a portion of it) can have a length of about 194 millimeters (7.64 inches), a depth of about 36 millimeters (1.42 inches), and a thickness of about 32 millimeters (1.26 inches). The telescoping top member 12*b* can have a length of about 204 millimeters (8.03 inches), a diameter of about 22.9 millimeters (0.90 inches), and a thickness of about 1.35 millimeters (0.05 inches). The main member 12*a* can have a length of about 1,102 millimeters (43.39 inches), an inner diameter of about 23.3 millimeters (0.92 inches), and a thickness of about 1.35 millimeters (0.05 inches). The horizontal members 30, 32 can have a length of about 100 millimeters (3.94 inches), a depth of about 40 millimeters (1.57 inches), and thickness of about 20 millimeters (0.79 inches). The vertical members 26, 28 can have a height (or largest vertical) dimension of about 130 millimeters (5.12 inches) and a thickness of about 6 millimeters (0.24 inches). The grip handle 24 can have a length of about 100 millimeters (3.94 inches), with an inner plastic handgrip having a diameter of about 23.4 millimeters (0.92 inches) and an outer rubber handgrip having a diameter of about 42 millimeters (1.65 inches). The foot member 12*c* can have a length of about 330 millimeters (12.99 inches), a diameter of about 22.8 millimeters (0.90 inches), and a thickness of about 1.4 millimeters (0.06 inches).

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention, which is set forth in the following claims.

What is claimed is:

1. A height adjustable crutch comprising:

a single tube member having a central axis along which a main member, a telescoping top member, and a telescoping foot member are aligned, the top member being adjustable relative to a top end of the main member, the foot member being adjustable relative to a bottom end of the main member;

a foot grip fixedly attached to the foot member for providing a frictional force between the single tube member and a supporting surface;

an underarm support fixedly attached to a top end of the top member for supporting an underarm of a user, the underarm support being generally perpendicular to the central axis of the single tube member; and a grip handle fixedly attached to the main member for supporting a hand of the user, the grip handle being offset from the central axis of the single tube, the grip handle having a central area separated by a void located directly between the grip handle and the main member, the grip handle being attached to the main member via bracket having a first member attached to a first end of the grip handle and a second member attached to a second end of the grip handle, the first member and the second member being parallel to each other and to the central axis of the single tube member, and a third member that is distinct and spaced apart from a fourth member, the third member being parallel to the fourth member and to the grip handle, each of the third member and the fourth member being attached to each of the first member and the second member, each of the third member and the fourth member having a central area that is coupled to the main member of the single tube member.

2. A height adjustable crutch used as a walking aid, the crutch comprising:

a single columnar member having a central axis, the columnar member including a main member and an underarm member aligned along the central axis, the underarm member and the main member being telescopically adjustable relative to each other;

an underarm support coupled to the underarm member, the underarm support having an elongated shape and being positioned so that its longest dimension is generally perpendicular to the central axis of the columnar member;

a grip handle coupled to the main member, the grip handle having a generally circular cross-sectional shape and being positioned such that a user can grip all regions of a central area of the grip handle, the regions including a region facing the main member, the grip handle being generally perpendicular to and spaced away from the main member;

a handle bracket for mounting the grip handle to the main member, the handle bracket including a first member and a second member, the first member having a semicircular shape and being attached to a first end of the grip handle, the second member having a semicircular shape and being attached to a second end of the grip handle, the first member and the second member being parallel along their entirety to each other and to the central axis of the single tube member, and a third member and a fourth member, the third member being parallel to the fourth member and to the grip handle, each of the third member and the fourth member being attached to each of the first member and the second member, each of the third member and the fourth member having a central area that is coupled to the main member of the single tube member.

3. The height adjustable crutch of claim 2, wherein the single columnar member includes aluminum and the grip handle includes rubber or plastic.

4. The height adjustable crutch of claim 2, wherein the longest dimension of the underarm support is at least about 7.6 inches.

5. The height adjustable crutch of claim 2, wherein the main member has an inner diameter of about 0.92 inches and a thickness of about 0.05 inches.

6. The height adjustable crutch of claim 2, wherein the grip handle includes an inner plastic handgrip and an outer rubber handgrip.

* * * * *